US012564770B2

(12) United States Patent
Simonet et al.

(10) Patent No.: US 12,564,770 B2
(45) Date of Patent: Mar. 3, 2026

(54) GOLF CLUB HEAD WITH HOSEL TILT

(71) Applicant: KARSTEN MANUFACTURING CORPORATION, Phoenix, AZ (US)

(72) Inventors: Mitchell J. Simonet, Phoenix, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 106 days.

(21) Appl. No.: 18/338,246

(22) Filed: Jun. 20, 2023

(65) Prior Publication Data

US 2023/0405414 A1 Dec. 21, 2023

Related U.S. Application Data

(60) Provisional application No. 63/366,651, filed on Jun. 20, 2022.

(51) Int. Cl.
*A63B 53/04* (2015.01)
*A63B 53/02* (2015.01)

(52) U.S. Cl.
CPC ..... *A63B 53/0412* (2020.08); *A63B 53/027* (2020.08); *A63B 53/0416* (2020.08); *A63B 2053/0491* (2013.01)

(58) Field of Classification Search
CPC ..... A63B 53/0412; A63B 53/0433; A63B 2053/0491
See application file for complete search history.

(56) References Cited

U.S. PATENT DOCUMENTS

| | | | | |
|---|---|---|---|---|
| 4,140,318 | A | 2/1979 | Izett | |
| 4,157,830 | A | 6/1979 | Taylor | |
| 5,375,840 | A | 12/1994 | Hirsch | |
| 7,846,033 | B2 | 12/2010 | Kato | |
| 8,272,974 | B2 | 9/2012 | Mickelson | |
| 8,771,097 | B2 | 7/2014 | Bennett | |
| 8,827,830 | B2 | 9/2014 | Beaulieu | |
| 8,876,633 | B2 | 11/2014 | Matsunaga | |
| 9,962,581 | B2 | 5/2018 | Cordle | |
| 11,612,789 | B2 * | 3/2023 | Cyrulik | A63B 60/52 473/324 |
| 2006/0073909 | A1 * | 4/2006 | Evans | A63B 60/02 473/342 |
| 2016/0059093 | A1 * | 3/2016 | Nielson | A63B 53/02 473/338 |
| 2016/0175665 | A1 | 6/2016 | Presse, IV | |
| 2021/0283474 | A1 | 9/2021 | Jertson | |
| 2022/0054903 | A1 | 2/2022 | Morales | |
| 2022/0105396 | A1 | 4/2022 | Beach | |

FOREIGN PATENT DOCUMENTS

| | | |
|---|---|---|
| JP | 2001112895 | 10/2001 |
| WO | 22021201473 | 10/2021 |

* cited by examiner

*Primary Examiner* — Raeann Gorden

(57) ABSTRACT

Some embodiments of the golf club head described herein comprise a club body, the club body having a crown opposite a sole, a toe end opposite a heel end, a club face opposite a back end, and a hosel. A hosel axis is defined by the hosel, wherein the hosel axis is oriented relative to a plane perpendicular to a surface upon which the sole rests at address to define a hosel tilt. The hosel tilt is greater than zero degrees. The club body defines a resting face angle that is open relative to an intended target line.

16 Claims, 12 Drawing Sheets

GOLF CLUB HEAD WITH HOSEL TILT

CROSS REFERENCE PRIORITIES

This application claims the benefit of U.S. Provisional Application 63/366,651, filed Jun. 20, 2022.

FIELD OF THE DISCLOSURE

The present disclosure relates to a golf club, and more specifically to a hybrid golf club.

BACKGROUND

Golf clubs take various forms, for example a wood, a hybrid, an iron, a wedge, or a putter. These clubs generally differ in head shape and design (e.g., the difference between a wood and an iron, etc.), club head material(s), shaft material(s), club length, and club loft.

With hybrid golf clubs, the club is designed as a replacement to lower lofted irons. The hybrid integrates launch and forgiveness characteristics of a fairway wood with a control and a distance of an iron. While these characteristics are helpful for a higher handicap golfer, who often needs forgiveness and assistance launching a shot into the air to maximize distance, these design characteristics can result in performance issues for lower handicap, better golfers. More specifically, the design attributes that assist a higher handicap golfer to improve forgiveness and shot trajectory can result in an undesirable aesthetic at address for a lower handicap golfer. Notably, the hybrid can have an appearance at address of a closed, or shut clubface. This address position is undesirable for a lower handicap golfer, who often prefers a neutral to slightly open address position.

The lower handicap golfer will often attempt to compensate for this undesired closed clubface position at address by rotating the club shaft to rotate the club head open. While this results in opening the hybrid club head at address (or a fade bias), it also raises the leading edge of the hybrid club head off the ground, as the sole of the hybrid contacts the ground at a position closer to the rear of the club (or further away from a face). This also undesirably adds loft to the hybrid. The combination of the raised leading edge and added loft with the open clubface provides a visual impression to a lower handicap golfer that a shot struck by the hybrid will not travel at the target, but instead will travel substantially offline. Generally, the lower handicap golfer perceives that the shot struck by the hybrid will travel to the player's side (i.e., the ball will travel left of target line for a right handed player or right of target for a left handed player of an intended target line (i.e., a pull or a hook).

Therefore, there is a need in the art for hybrids that appease low handicap players, such that they play to the low handicap players preferences and aesthetics, while providing improved launch and forgiveness.

DETAILED DESCRIPTION

Figure 1:
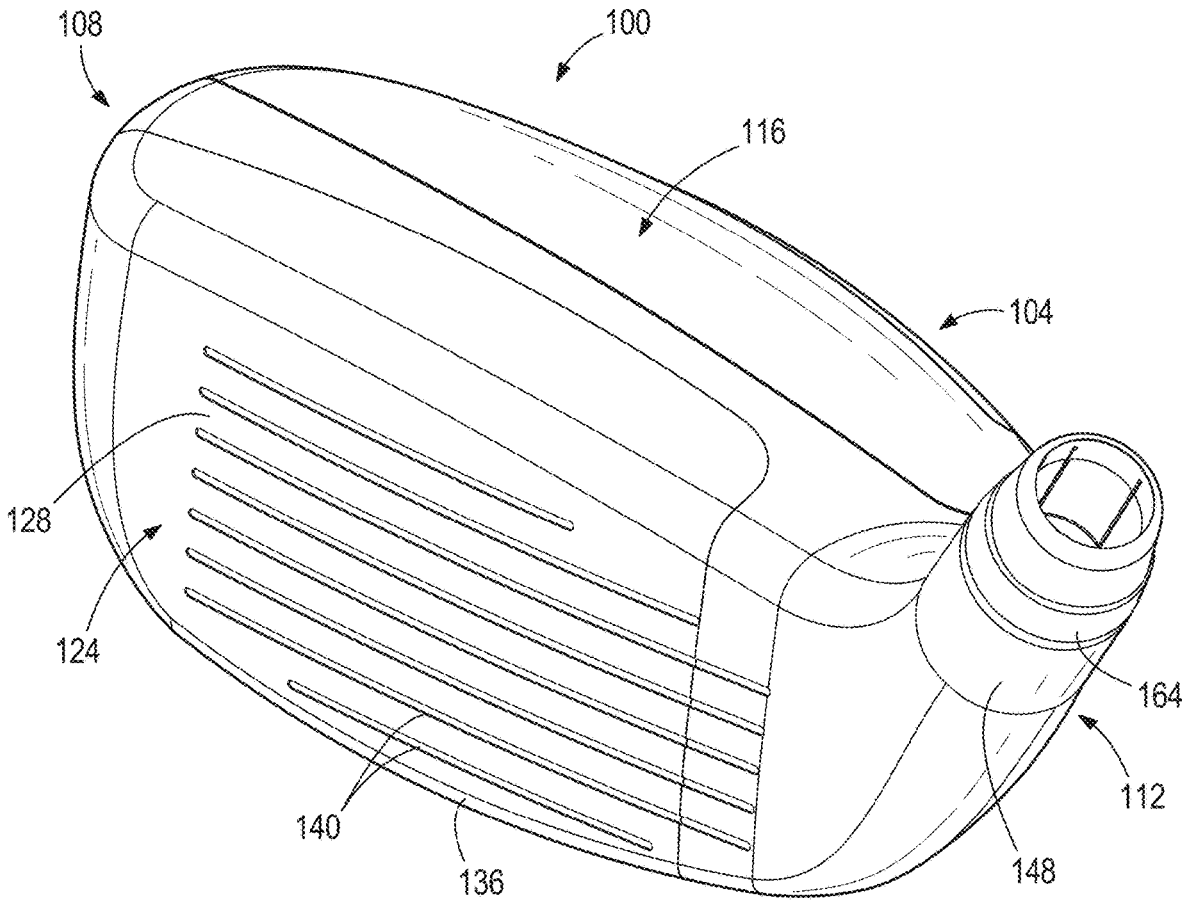
FIG. 1 is a perspective view of an example of an embodiment of a golf club head.

The present invention relates to a golf club that incorporates an improved resting face angle and center of gravity position to reduce a hook-bias, as well as a set up visual aesthetic that is preferred by a lower handicap golfer. The golf club head comprises a hosel axis defined by the hosel and oriented relative to a plane perpendicular to a surface upon which the sole rests at address to define a hosel tilt, wherein the hosel tilt is greater than zero degrees. The club body defines a resting face angle that is open relative to an intended target line. Low handicap players require the above described features to have confidence in the shot they can execute. Some, low handicap players are unable to hit low lofted iron type clubs such as a 3 iron or 4 iron due to how they deliver the club head at impact and therefore need a hybrid type club to obtain the preferred launch and spin characteristics. The low handicap players that require a hybrid type club over a low lofted iron, however, do not need the left bias that a traditional hybrid type club provides. The traditional hybrid type clubs provide a left bias for a high handicap player, as it is understood that higher handicap players typically struggle to obtain a ball flight that goes left of target line. Accordingly, the present invention provides a low handicap player with a balance between the launch and spin characteristics that a hybrid type golf club provides along with a club head that does not have a left bias and therefore the low handicap player can execute the shot they deem desirable.

Definitions

The terms "loft" or "loft angle" of a golf club, as described herein, refers to the angle formed between the club face and the shaft, as measured by any suitable loft and lie machine.

The term "face angle" of a golf club, as described herein, refers to the angle formed between the club face and the intended target line, and more specifically between the club face and an imaginary line that extends from the golf club head through a golf ball along a player's intended target line. The terms "face angle at address" or "resting face angle" of a golf club, as described herein, refers to the angle formed between the club face and the players intended target line at address (i.e., prior to the swing), and more specifically between the club face and an imaginary line that extends from the golf club head through the golf ball along a player's intended target line at address. It should be appreciated that the face angle is in a neutral position when the club face is square (or generally perpendicular) to the intended target line. The face angle is in an open position when the club head rotates about the shaft such that the toe end moves away from the ball. The face angle is in a closed position when the club head rotates about the shaft such that the toe end moves towards the golf ball.

The terms "first," "second," "third," "fourth," "fifth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise, either directly or indirectly. Coupling (whether mechanical or otherwise) may be for any length of time, e.g., permanent or semi-permanent or only for an instant.

The terms "loft" or "loft angle" of a golf club, as described herein, refers to an angle formed between a club face and a shaft, as measured by any suitable loft and lie machine.

The term "driving iron" and the like, as described herein, refers to an iron shaped golf club with a low loft, typically in the range of 15-21 degrees. A driving iron is typically a hollow body iron.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 100 as a hybrid (or a hybrid-type club head). It should be appreciated that the hybrid is provided for purposes of illustration, and one or more of the attributes disclosed herein are not limited to a hybrid. The attributes can be used on any desired golf club, including a driver, a wood, a hybrid, an iron, or other golf club where a resting face angle, hosel tilt, center of gravity (CG), or other attributes to provide an improved performance and aesthetic for a player is desired. For example, the club head 100 can include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 100 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 51, 51.5, 52, 52.5, 53, 53.5, 54, 54.5, 55, 55.5, 56, 56.5, 57, 57.5, 58, 58.5, 59, 59.5, 60.5, 61. 61.5, 62, 62.5, 63, 63.5, 64, 64.5, and/or 65 degrees).

In one example of an embodiment, the loft angle of a hybrid-type club head 100 can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in other examples of embodiments, the loft angle of the hybrid-type club head 100 can be greater than approximately 14 degrees, greater than approximately 15 degrees, greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The volume of a hybrid-type club head 100 can be less than approximately 200 cubic centimeters (cc), less than approximately 175 cc, less than approximately 150 cc, less than approximately 125 cc, less than approximately 100 cc, or less than approximately 75 cc. In other examples of embodiments, the volume of the hybrid-type club head 100 can be approximately 110 cc to approximately 150 cc, and more specifically approximately 100 cc to approximately 140 cc, and more specifically approximately 90 cc to approximately 130 cc, and more specifically approximately 108 cc to approximately 110 cc. In yet other examples of embodiments, the volume of the hybrid-type club head 100 can be approximately 75 cc to approximately 150 cc, approximately 100 cc to approximately 125 cc, or approximately 75 cc to approximately 125 cc.

Referring now to the figures, FIGS. 1-10 illustrate an embodiment of the golf club head 100 comprising an open resting face angle and negative hosel tilt. The golf club head 100 includes a club body 104 (or body 104) having a toe 108 (or a toe end 108) opposite a heel 112 (or a heel end 112). The body 104 also includes a crown 116 (or a top 116) opposite a sole 120 (or a bottom 120). The body 104 carries a face plate 124 (or a strike plate 124 or a club face 124 or a strike face 124) that defines a strike surface 128. The face plate 124 is opposite a rear end 132 (or a back 132 or a rear 132 or a back side 132). The face plate 124 includes a leading edge 136. The face plate 124 can also include a plurality of grooves 140. The body 104 also defines a skirt 144. The skirt 144 is a portion of the club head 100 between the crown 116 and the sole 120. The club body 104 defines a substantially hollow closed interior volume.

The golf club head 100 also includes a hosel 148 positioned at the heel 112. The hosel 148 defines a hosel axis 150 that extends through a center of the hosel 148. The hosel 148 is configured to receive a golf club shaft (not shown) that carries a grip (not shown). With specific reference to FIG. 5, a plane 152 is illustrated. The plane 152 is an imaginary plane that is generally perpendicular to a ground surface in response to the club body 104 being at an address position. The plane 152 is in contact with the leading edge 136 of the face plate 124. The hosel axis 150 is oriented at an angle to the plane 152. Stated another way, the hosel axis 150 is oriented oblique to the plane 152. The hosel axis 150 and the plane 152 define a first angle $\Theta_1$. The first angle $\Theta_1$ is representative of the hosel tilt. In the illustrated embodiment, the hosel tilt (or first angle $\Theta_1$) is approximately 0.5 degrees to approximately 2.0 degrees, and more specifically approximately at least 1.5 degrees. The hosel tilt is oriented such that the hosel axis 150 extends away from the plane 152. Stated another way, the hosel axis 150 is configured to intersect the plane 152 at an imaginary position below the ground surface.

This hosel tilt, or negative hosel tilt relative to the plane 152, is preferred by lower handicap players, as it allows the player to position their hands behind the ball (or towards a trail or rear foot of the player) at the address position. This is a preferred hand position for lower handicap players with woods, hybrids, and long irons, as these players generally position the ball forward of middle in their stance, but their hands remain at (or near) the middle of their stance. Thus, the hands are generally positioned behind the ball at the address position. It should be appreciated that hybrid golf clubs currently on the market generally have a hosel axis 150 that is parallel to the plane 152, or a positive hosel tilt. With a positive hosel tilt, the hosel axis 150 is angled towards the plane 152 such that the hosel axis 150 intersects the plane 152 at an imaginary position above the ground surface. When the club is at the address position the sole 120 (or a portion of the sole 120) contacts the ground. It should be appreciated that at the address position, the club body 104 is in contact with the ground. How the sole 120 (or a portion of the sole 120) contacts the ground contributes to a resting face angle (RFA) of the club head 100.

Figure 10:
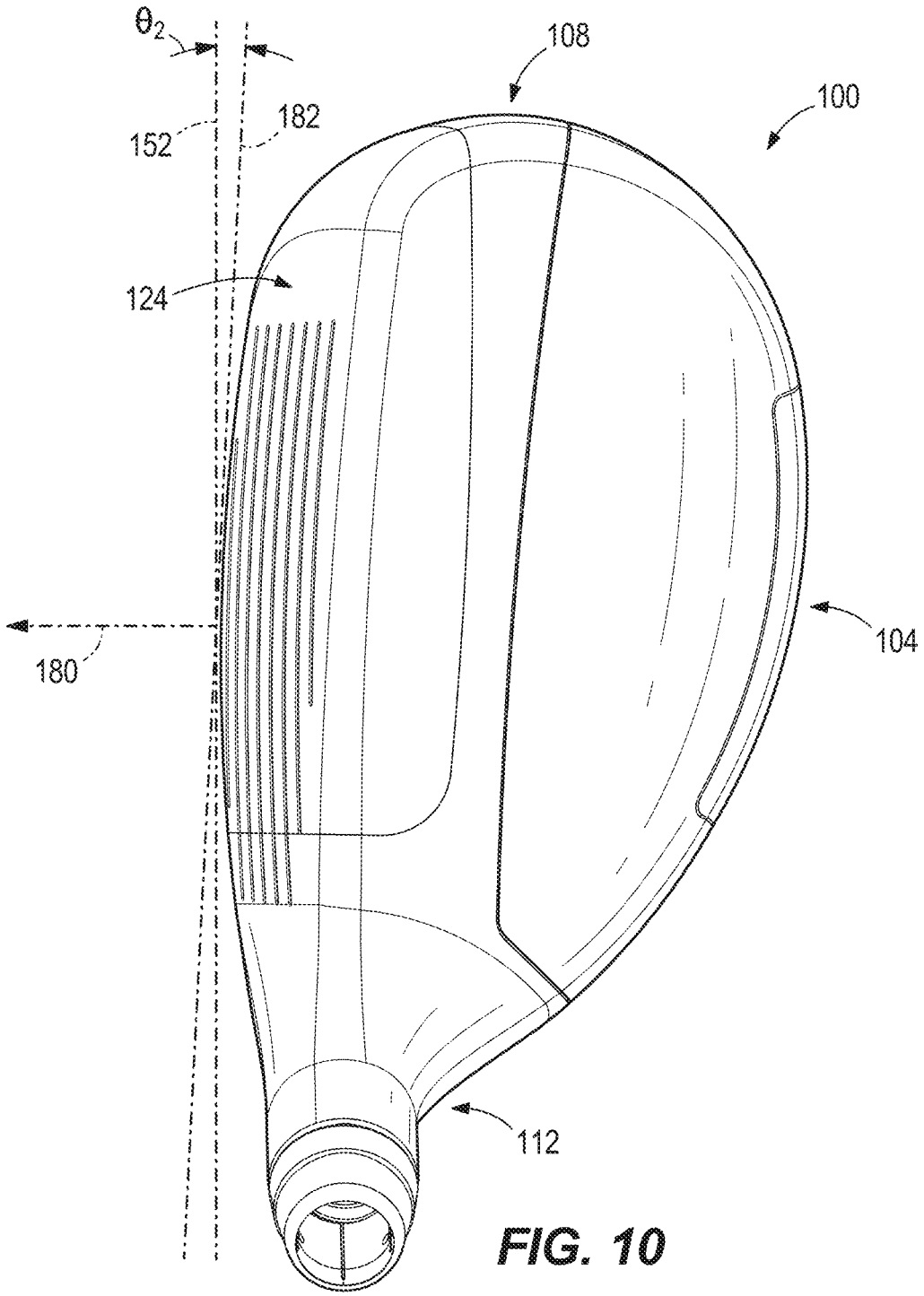
FIG. 10 is another top (or crown) view of the golf club head of FIG. 1.

The club head 100 RFA provides a visually pleasing aesthetic preferred by a lower handicap golfer. The term "resting face angle" of the golf club head 100 refers to an angle formed between the club face 124 and a plane that is perpendicular to the players intended target line 180. With reference to FIG. 10, the player's intended target line 180 of the golf club head 100 is illustrated relative to the imaginary plane 152. The intended target line 180 can be perpendicular to the imaginary plane 152 perpendicular to the ground surface. In addition, a plane 182 parallel to the orientation of the club face 124 at address is illustrated relative to the imaginary plane 152. Stated another way, the plane 182 is the orientation plane 182 of the club face 124.

It should be appreciated that if the resting face angle is in a neutral position, the club face 124 (and the associated orientation plane 182) is square to the intended target line 180. Stated another way the orientation plane of the club face 124 (and the associated orientation plane 182) is perpendicular to the intended target line 180. It should be appreciated that if the resting face angle is in an open position, the club body 104 rotates relative to the shaft (or around the hosel axis 150) such that the toe 108 moves away from the ball (or moves away from the intended target line 180). It should be appreciated that if the resting face angle is in a closed position, the club body 104 rotates relative to the shaft (or around the hosel axis 150) such that the toe 108 moves towards the ball (or moves towards the intended target line 180).

As illustrated in FIG. 10, the RFA results in a slightly open club face 124 (i.e. a club face that points right of intended target line for a right handed player, and left for a left handed player). The open club face 124 can comprise a RFA of 0.5 degrees to 2.0 degrees, or conversely 90.5 degrees to 92.0 degrees. The open club face 124 is a visually pleasing aesthetic at address for a lower handicap golfer. Since the resting face angle is slightly open, the golf club head 100, and more specifically the golf club body 104, is rotated relative to the shaft (or around the hosel axis 150) such that the toe 108 moves away from the intended target line 180. This opens the club face 124 relative to the imaginary plane 152 to define a second angle $\Theta_2$. The second angle $\Theta_2$ is the angular difference between the orientation plane 182 of the club face 124, which is parallel to the club face 124, and the imaginary plane 152. The second angle $\Theta_2$ is at least 0.5 degrees open, and more specifically approximately 0.5 degrees to approximately 2.0 degrees open. The second angle $\Theta_2$ can be 0.5 degrees, 1.0 degrees, 1.5 degrees, or 2.0 degrees. The second angle $\Theta_2$ can be between 0.5 degrees and 1.5 degrees, or 1.5 degrees and 2.0 degrees. The second angle $\Theta_2$ can be greater than 0.5 degrees, greater than 1.0 degrees, greater than 1.5 degrees.

If the resting face angle is measured from the intended target line 180 to the club face 124 (or to the orientation plane 182 parallel to the club face 124), the resting face angle is at least 90.5 degrees, and more specifically approximately 90.5 degrees to approximately 92.0 degrees, with 90 degrees being square to the intended target line 180. The resting face angle can be 90.5 degrees, 91.0 degrees, 91.5 degrees, or 92.0 degrees. The resting face angle can be between 90.5 degrees and 91.5 degrees, or 91.5 degrees and 92.0 degrees. The resting face angle can be greater than 90.5 degrees, greater than 91.0 degrees, greater than 91.5 degrees.

The RFA of the golf club head 100 can be dictated by a relationship between the location on the sole 120 at which the club naturally rests on the ground surface at address, commonly referred to as the keel point, and the center of gravity 154 of the club. In some embodiments of the golf club head, only one keel point exists. In such embodiments, the keel point will generally align with the CG of the golf club head, allowing an imaginary axis perpendicular to the ground to pass through both the keel point and the center of gravity 154 of the club.

In other examples of embodiments, such as the golf club head 100, two keel points exist. In such embodiments, a first keel point 184 is located on a first side of the sole 120 relative to the center of gravity 154, and a second keel point 186 is located on a second side of the sole 120 relative to the center of gravity 154. The first and second sides can be separated by the x-axis 155, which extends from the toe 108 to the heel 112 and through the center of gravity 154. Stated another way, the first side is a portion of the sole 120 position on a first side of the x-axis 155, and the second side is a portion of the sole 120 positions on a second, opposite side of the x-axis 155.

Figure 9:
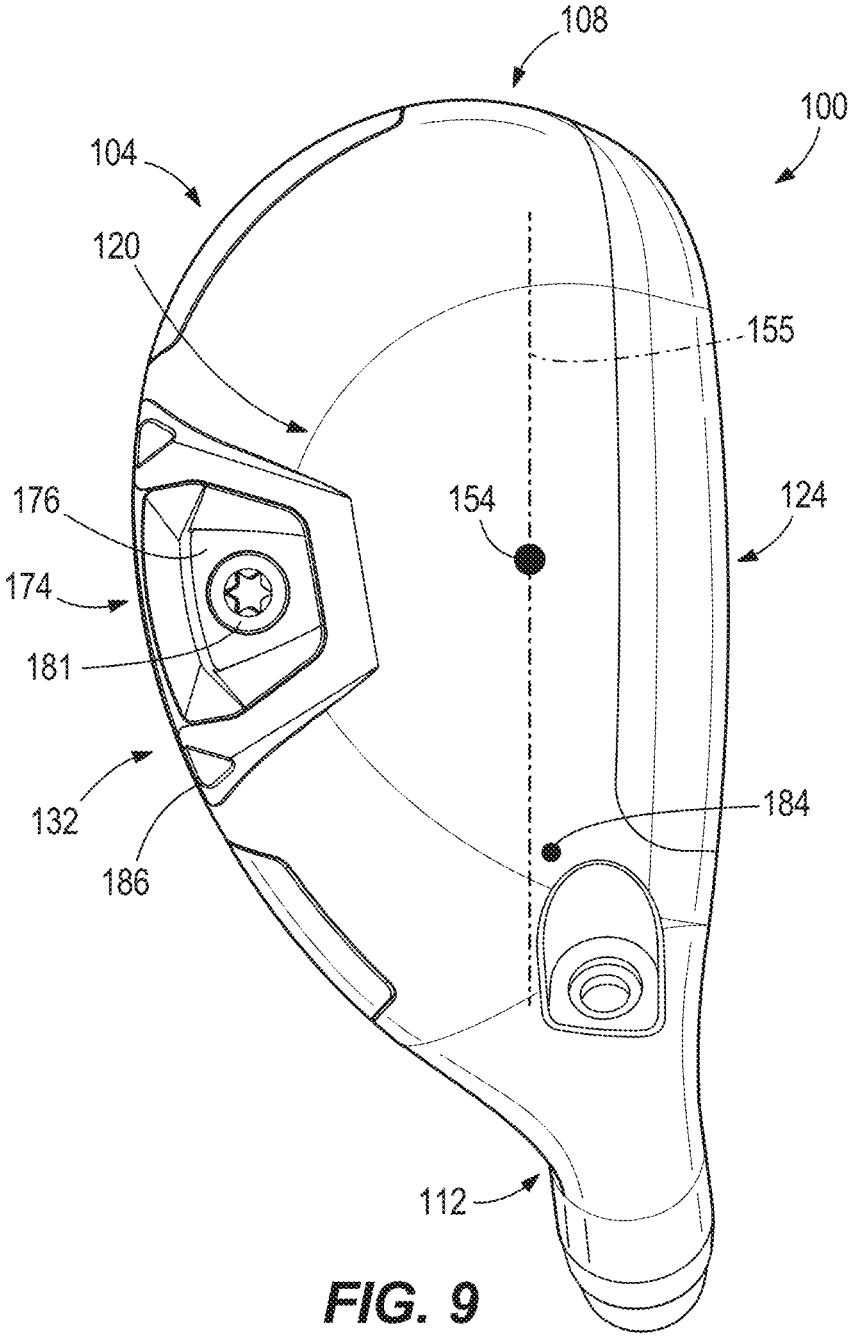
FIG. 9 is a bottom (or sole) view of the golf club head of FIG. 1, with a fastener removed.

With reference to FIG. 9 and FIG. 10, the first keel point 184 (or the first keel surface 184) is positioned on the sole 120 between the center of gravity 154 and the club face 124. The second keel point 186 (or the second keel surface 186) is positioned on the sole 120 between the center of gravity 154 and the back end 132. The second keel surface 186 is defined by a portion of a weight recess 178, and more specifically by a portion of the perimeter that defines the weight recess 178. In embodiments of the golf club head 100 without a weight assembly 174, the second keel surface 186 can be defined by a portion of the sole 120 positioned between the center of gravity 154 and the back end 132.

To maintain a slightly open resting face angle, while incorporating the stability provided by a two-keel point sole, the first keel point 184 can have a slightly greater keel point height than the second keel point 186. A keel point height 190 is referred to as a distance by which the keel point 184 or 186 projects outward, away from the sole 120, towards the ground. The keel point height 190 can be measured from a center of gravity (CG) of the club head. The greater the keel point height 190 of the keel point 184 or 186, the more protruded the keel point 184 or 186 is from the remainder of the sole 120. In embodiments having a two-keel point sole, increasing the keel point height 190 of the first keel point 184, while maintaining the keel point height 190 of the second keel point 186 results in a more open resting face angle. Similarly, decreasing the keel point height 190 of the second keel point 186, while maintaining keel point height 190 of the first keel point 184 results in a more open resting face angle. Conversely, increasing the keel point height 190 of the second keel point 186, while maintaining the keel point height 190 of the first keel point 184, or decreasing the keel point height 190 of the first keel point 184 while maintaining the keel point height 190 of the second keel point 186 results in a more closed resting face angle.

In the illustrated embodiment of the golf club head 100, the first keel point 184 generally has a keel point height that is greater than the second keel point 186 to facilitate the slightly open resting face angle that provides a visually pleasing aesthetic preferred by a lower handicap golfer.

The first keel point 184 comprises a first keel point height measured along the Y-Axis from the CG between 0.455 in and 0.465 in. In some examples, the first keel point height can be 0.455 in, 0.456 in, 0.457 in, 0.458 in, 0.459 in, 0.460 in, 0.461 in, 0.462 in, 0.463 in, 0.464 in, or 0.465 in. The first keel point height can be greater than 0.455 in, greater than 0.456 in, greater than 0.457 in, greater than 0.458 in, greater than 0.459 in, greater than 0.460 in, greater than 0.461 in, greater than 0.462 in, greater than 0.463 in, or greater than 0.464 in. The first keel point height can be less than 0.465, less than 0.464 in, less than 0.463 in, less than 0.462 in, less than 0.461 in, less than 0.460 in, less than 0.459 in, less than 0.458 in, less than 0.457 in, or less than 0.456 in.

The second keel point 186 comprises a second keel point height measured along the Y-Axis from the CG between 0.445-0.455. In some examples, the second keel point height can be 0.445 in, 0.446 in, 0.447 in, 0.448 in, 0.449 in, 0.450 in, 0.451 in, 0.452 in, 0.453 in, 0.454 in, or 0.455 in. The second keel point height can be greater than 0.445 in, greater than 0.446 in, greater than 0.447 in, greater than 0.448 in, greater than 0.449 in, greater than 0.450 in, greater than 0.451 in, greater than 0.452 in, greater than 0.453 in, greater than 0.454 in. The second keel point height can be less than 0.455 in, 0.454 in, less than 0.453 in, less than 0.452 in, less than 0.451 in, less than 0.450 in, less than 0.449 in, less than 0.448 in, less than 0.447 in, or less than 0.446 in. The first keel point height and the second keel point height can have a difference in height of 0.001 in-0.01 in. The difference in height can be 0.001 in, 0.005 in, 0.01 in.

Figure 15:
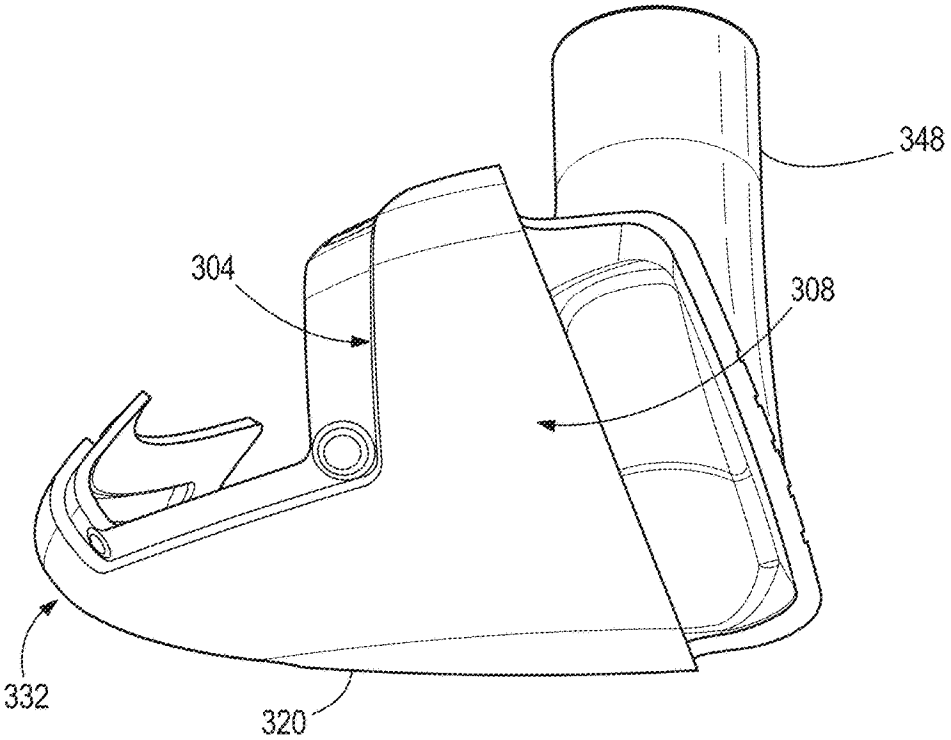
FIG. 15 is a toe end view of the golf club body of FIG. 14.
Figure 14:
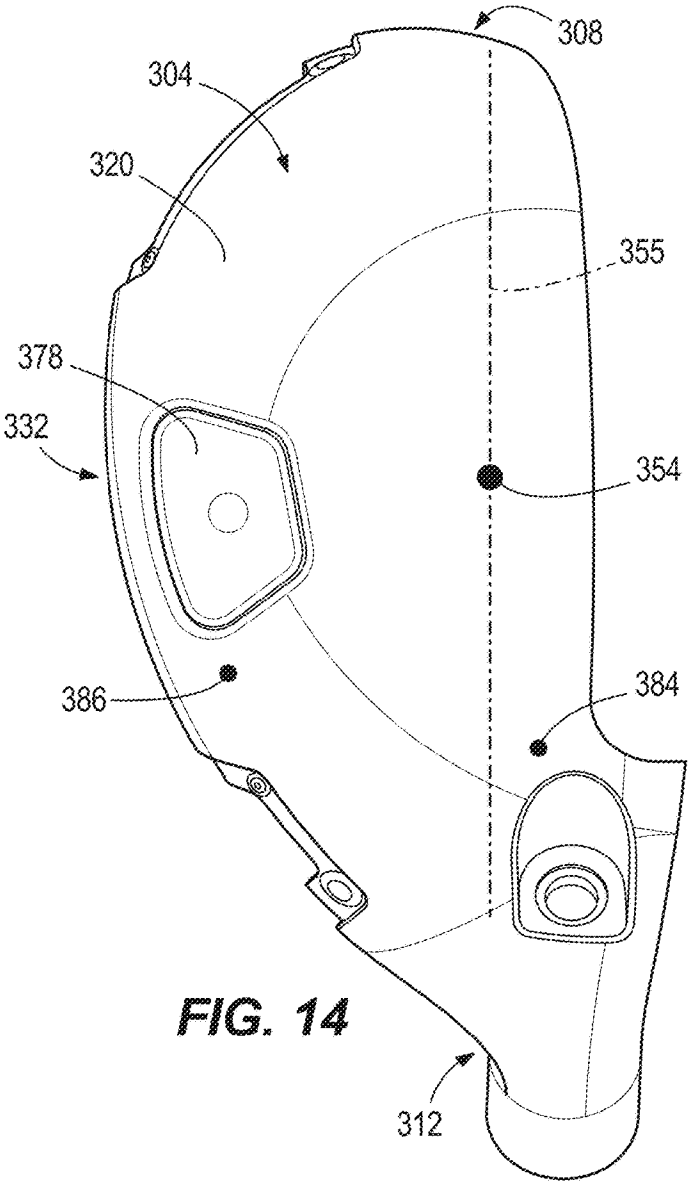
FIG. 14 is a bottom (or sole) view of an embodiment of a golf club body.

With reference to FIGS. 14 and 15, an alternative embodiment of a club body 304 comprising a sole 320 devoid of any protrusions. In other words, the sole 320 comprises a smooth contoured surface throughout. The club body 304 further comprising a first keel point 384 and a second keel point 386. The smooth sole 320 allows the second keel point 386 height to be decreased relative to the first keel point 384 height. Thus, providing a club head utilizing the club body 304 with an open RFA.

The club body 304 comprises similar features to the club body 104 discussed herein. The club body 304 comprises a toe 308, a heel 312, a back end 332, a hosel 348, a center of gravity 354, an x-axis 355, a weight recess 378, and other features similar to club body 104 not shown in FIGS. 14 and 15. Further the weight recess 378 is configured to receive a removable weight (not shown) similar to the removable weight 176 described herein. The club body 304 can be used in any combination of the features described herein. The club body 304 is an alternative embodiment to club body 104 and it is understood it can be used interchangeably as such.

The first keel point 384 comprises a first keel point height measured along the Y-Axis from the CG between 0.450 in and 0.465 in. In some examples, the first keel point height can be 0.450 in, 0.451 in, 0.452 in, 0.453 in, 0.454 in, 0.455 in, 0.456 in, 0.457 in, 0.458 in, 0.459 in, 0.460 in, 0.461 in, 0.462 in, 0.463 in, 0.464 in, or 0.465 in. The first keel point height can be greater than 0.450 in, greater than 0.451 in, greater than 0.452 in, greater than 0.453 in, greater than 0.454 in, greater than 0.455 in, greater than 0.456 in, greater than 0.457 in, greater than 0.458 in, greater than 0.459 in, greater than 0.460 in, greater than 0.461 in, greater than 0.462 in, greater than 0.463 in, or greater than 0.464 in. The first keel point height can be less than 0.465 in, less than 0.464 in, less than 0.463 in, less than 0.462 in, less than 0.461 in, less than 0.460 in, less than 0.459 in, less than 0.458 in, less than 0.457 in, less than 0.456 in, less than 0.455 in, less than 0.454 in, less than 0.453 in, less than 0.452 in, less than 0.451 in.

The second keel point 386 comprises a second keel point height measured along the Y-Axis from the CG between 0.325-0.40. In some examples, the second keel point height can be 0.325 in, 0.330 in, 0.335 in, 0.340 in, 0.345 in, 0.350 in, 0.355 in, 0.360 in, 0.365 in, 0.370 in, 0.375 in, 0.380 in, 0.385 in, 0.390 in, 0.395 in, or 0.400 in. The second keel point height can be greater than 0.325 in, 0.335 in, 0.345 in, 0.355 in, 0.365 in, 0.375 in, 0.385 in, or 0.395 in. The second keel point height can be less than 0.400 in, 0.390 in, 0.380 in, 0.370 in, 0.360 in, 0.350 in, 0.340 in, or 0.330 in. The first keel point height and the second keel point height can have a difference in height of 0.05 in-0.140 in. The difference in height can be 0.05 in, 0.06 in, 0.07 in, 0.08 in, 0.09 in, 0.10 in, 0.11 in, 0.12 in, 0.13 in, or 0.14 in.

Figure 2:
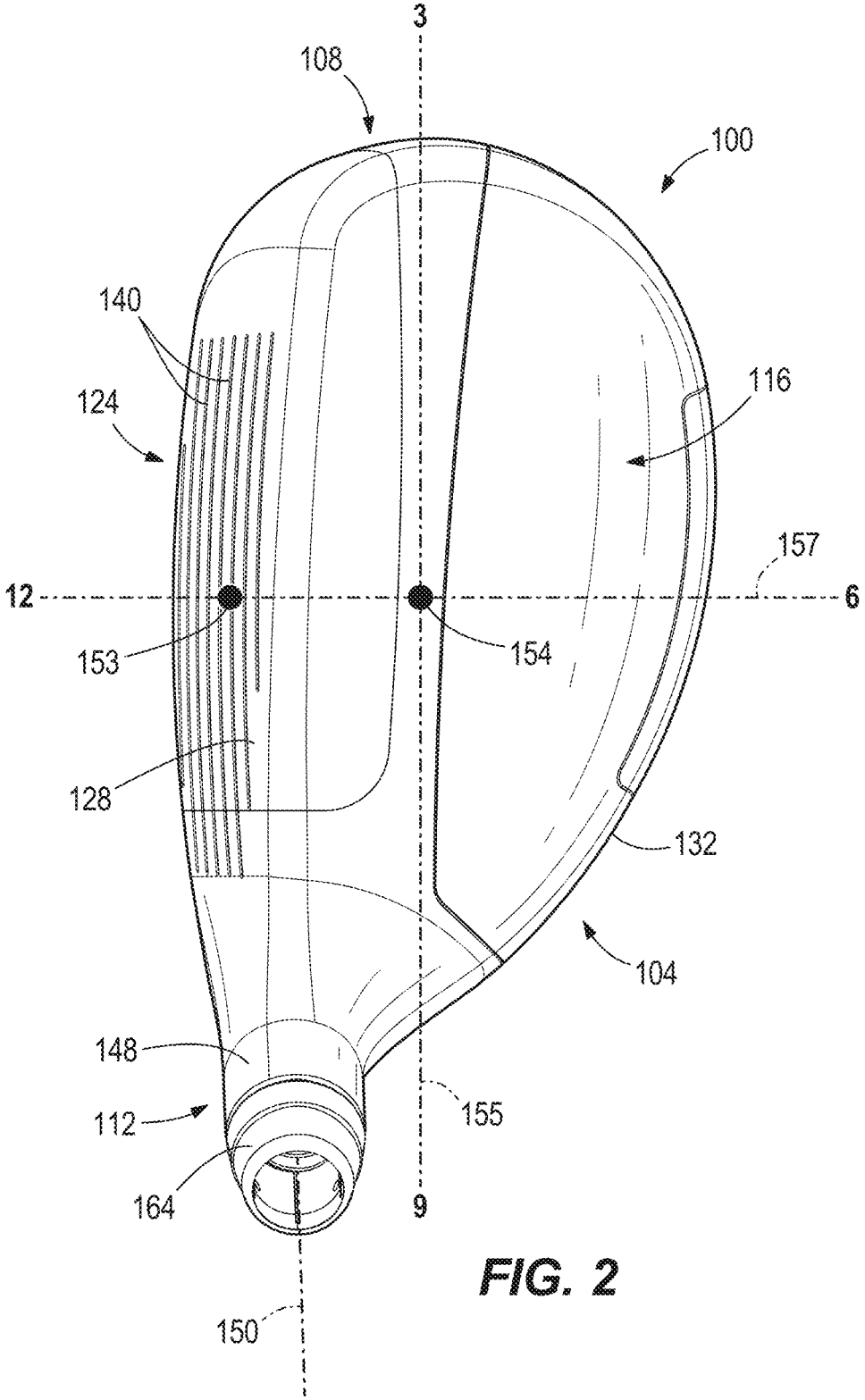
FIG. 2 is a top (or crown) view of the golf club head of FIG. 1.

With reference specifically to FIG. 2, the strike surface 128 of the golf club head 100 includes a geometric center 153. The geometric center 153 can be located at a geometric center point, and at a midpoint of a height of the strike surface 128. In one or more examples of embodiments of the golf club head 100, the geometric center 153 can be centered with respect to an engineered impact zone. The engineered impact zone can be defined by a region of grooves 140 on the strike surface 128. As another example, the geometric center 153 can be located in accordance with a definition established by a golf governing body, such as the United States Golf Association (USGA).

Figure 3:
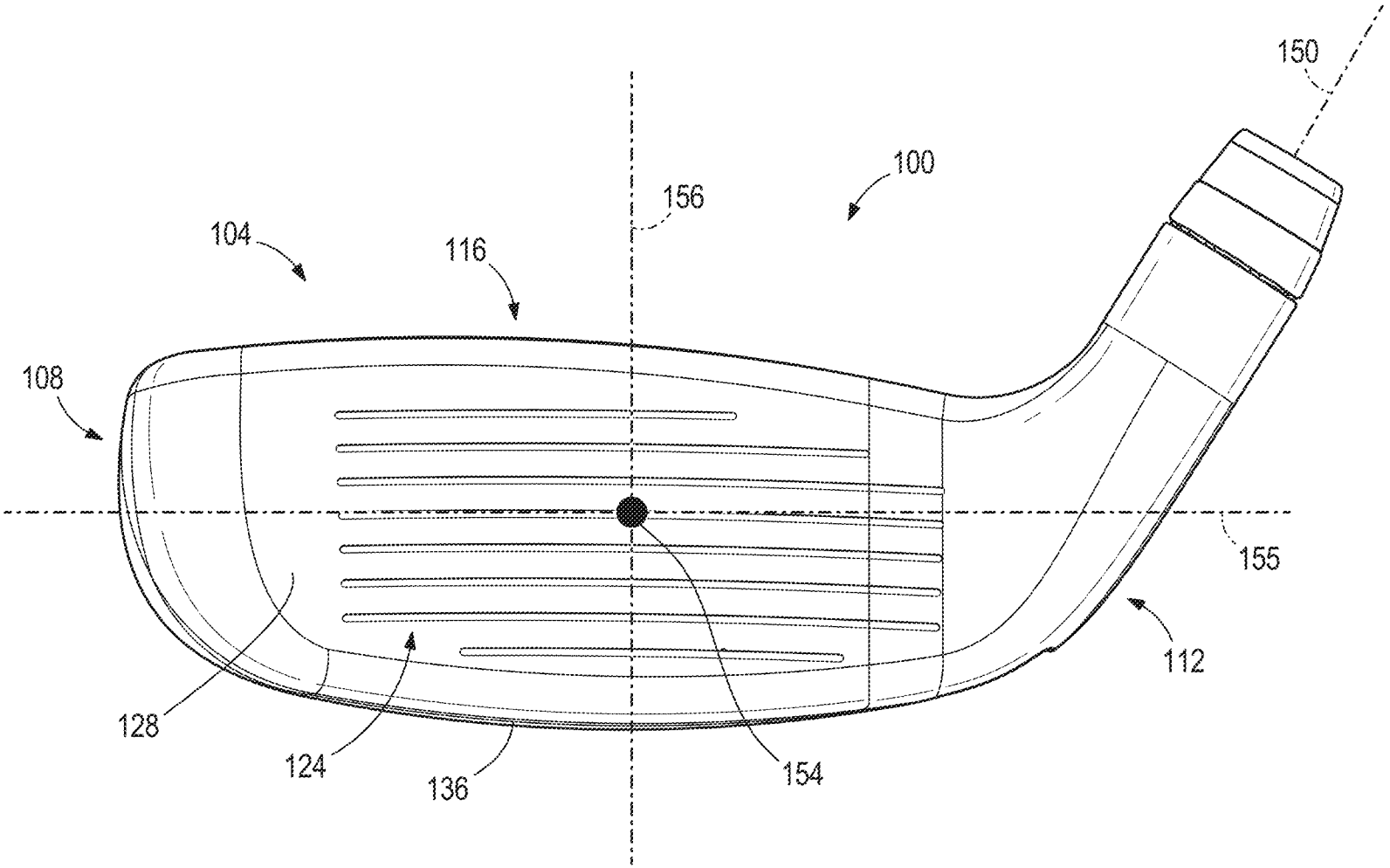
FIG. 3 is a first side view of the golf club head of FIG. 1, illustrating a face plate.
Figure 4:
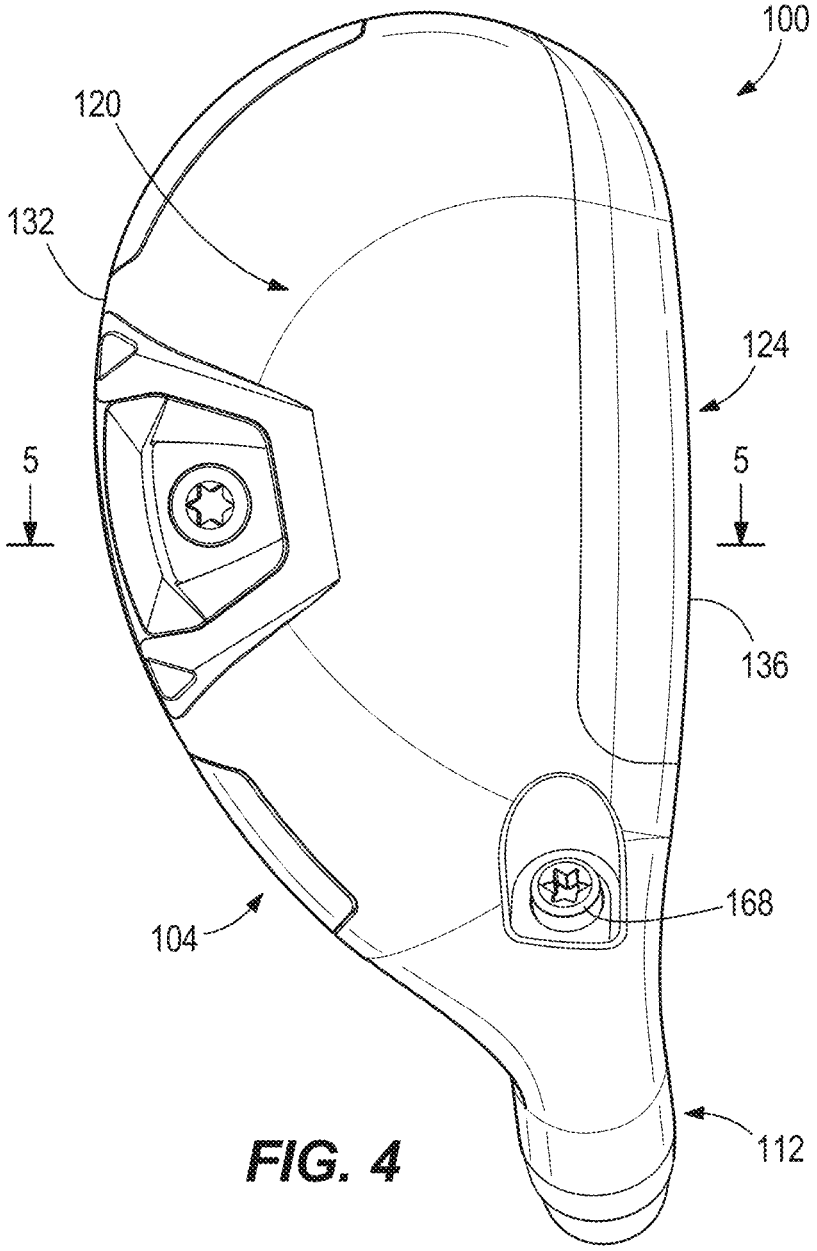
FIG. 4 is a bottom (or sole) view of the golf club head of FIG. 1.

With reference to FIGS. 2 and 3, the golf club head 100 includes a center of gravity 154 (or CG 154). The center of gravity 154 location can be defined relative to a coordinate system establishing an x-axis 155, a y-axis 156, and a z-axis 157. The center of gravity 154 defines an origin of the coordinate system including the axes 155, 156, 157. The x-axis 155 (shown in FIGS. 2 and 3) extends through the club head center of gravity 154 from the toe 108 to the heel 112. The x-axis is positive towards the toe. The y-axis 156 (shown in FIG. 3) extends through the club head center of gravity 154 from the crown 116 to the sole 120. The y-axis is positive towards the crown. The y-axis 156 is perpendicular to the x-axis 155 when viewed from the front view (or from the face plate 124). The y-axis 156 is oriented at an oblique angle to the hosel axis 150. The z-axis 157 (shown in FIG. 2) extends through the center of gravity 154 from the face plate 124 to the back end 132 of the golf club head 100. The z-axis is positive towards the face plate. The z-axis 157 is perpendicular to the x-axis 155 and the y-axis 156.

For additional guidance in describing the present invention herein, the x-axis 155 and the z-axis 157 are arranged to coincide with numbers on an analog clock in FIG. 2. The z-axis 157 extends between 12 o'clock ("12" through the face plate 124) and 6 o'clock ("6" through the back end 132), and the x-axis 155 extends between 3 o'clock ("3" through the toe end 108) and 9 o'clock ("9" through the heel end 112).

The center of gravity can be measured along the x-axis 155 and is represented by CGx. The center of gravity can also be measured along the y-axis 156 and is represented by CGy. The center of gravity can be measured along the z-axis 157 and is represented by CGz. Moving the center of gravity towards the toe 108 or the heel 112 can be achieved by increasing or decreasing the distance along the x-axis 155. Lowering the center of gravity can be achieved by decreasing the distance along the y-axis 156. Moving the center of gravity rearward can be achieved by increasing the distance along the z-axis 157. In a preferred embodiment, the center of gravity location can be measured from the geometric center 153. In other examples of embodiments, the center of gravity location can be measured from the leading edge 136 of the golf club head 100 (or from a furthest forward position of the golf club head 100).

In the illustrated embodiment, the hybrid golf club head 100 comprises a center of gravity located along the x-axis 155 at an approximate center of the strike surface 128. In other examples the center of gravity can be positioned at least 0.001 inch towards the toe 108 of the strike surface 128, and more specifically approximately 0.001 inch to approximately 0.25 inch towards the toe 108 of the strike surface 128 (as measured from the geometric center 153). The CG can be 0.001 inch to 0.01 inch towards the toe, 0.01-0.05 0.05 inch towards the toe, 0.05-0.1 inch towards the toe, 0.1-0.15 inch towards the toe, This center of gravity position is intended to not promote a hook bias.

The hybrid golf club head 100 also has a center of gravity located along the x-axis 155 (of CGx) of approximately 0.001 inch to approximately 0.500 inch, as measured from the geometric center 153. The hybrid golf club head 100 also has a center of gravity located along the y-axis 156 (of CGy) of approximately 0.200 inch to approximately 0.500 inch, as measured from the geometric center 153. The hybrid golf club head 100 also has a center of gravity located along the z-axis 157 (of CGz) of approximately 0.100 inch to approximately 0.300 inch, as measured from the geometric center 153. In the illustrated embodiment the CGx is 0.008 inch, the CGy is 0.294 inch and the CGz is inch when measured from the geometric center 153.

The hybrid golf club head 100 also has a center of gravity located along the y-axis 156 (of CGy) of approximately 0.300 inch to approximately 0.500 inch, as measured from the leading edge 136 (or the most forward point on the golf club head 100). The hybrid golf club head 100 has a center of gravity located along the z-axis 157 (of CGz) of approximately 0.700 inch to approximately 1.100 inch, as measured from the leading edge 136 (or the most forward point on the golf club head 100).

In addition to the above-described features, the golf club head 100 can further comprise other attributes such as a hosel adapter, various removable weight configurations, a face cup insert, and a second component that can comprise the crown of the club head or a portion of the club head.

Figure 7:
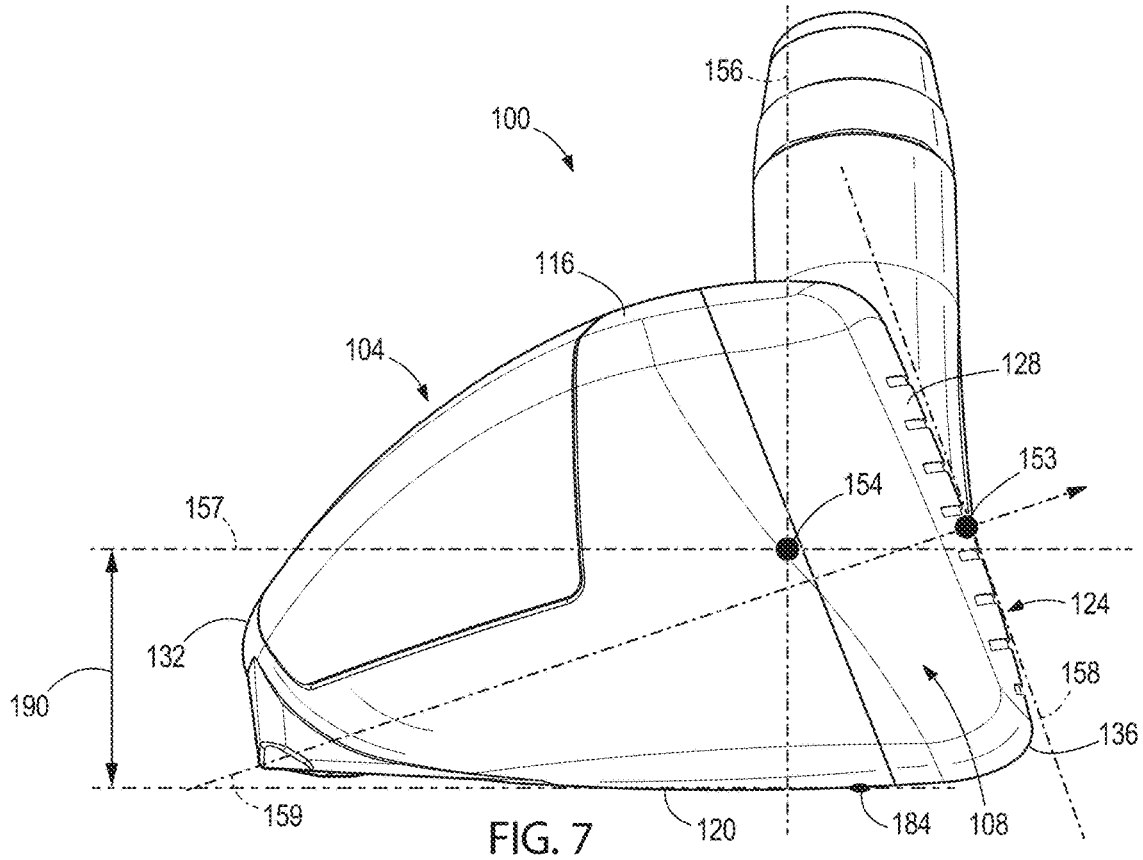
FIG. 7 is a toe end view of the golf club head of FIG. 1.

With specific reference to FIG. 7, the golf club head 100 further defines a loft plane 158. The loft plane 158 is tangent to the geometric center 153 of the strike surface 128. A strike face perimeter can be located along an outer edge of the strike surface 128. The strike face perimeter can define a boundary where a curvature of the strike surface 128 deviates from a bulge and roll curvature. In addition, a face height can be measured parallel to the loft plane 158 between a top end of the striking face perimeter near the crown 116 and a bottom end of the striking face perimeter near the sole 120.

In the illustrated embodiment of the hybrid golf club head 100, the loft plane 158 is positioned approximately 0.100 inches to approximately 0.650 inches from the center of gravity 154. In some embodiments, the loft plane 158 is positioned 0.100 in to 0.150 in from the center of gravity 154, 0.150 in to 0.200 in from the center of gravity 154, 0.200 in to 0.250 in from the center of gravity 154, 0.250 in to 0.300 in from the center of gravity 154, 0.300 in to 0.350 in from the center of gravity 154, 0.350 in to 0.400 in from the center of gravity 154, 0.400 in to 0.450 in from the center of gravity 154, 0.450 in to 0.500 in from the center of gravity 154, 0.500 in to 0.550 in from the center of gravity 154, 0.550 in to 0.600 in from the center of gravity 154, or 0.600 in to 0.650 in from the center of gravity 154.

With continued reference to FIG. 7, the golf club head 100 includes an impact force line 159. The impact force line 159 can be an imaginary line that extends through a center of a golf ball struck by the strike surface 128 of the face plate 124. The impact force line 159 can be oriented perpendicular to the face plate 124, and more specifically perpendicular to the strike surface 128. In some embodiments, the impact force line 159 can extend through the geometric center 153 of the strike surface 128.

Figure 8:
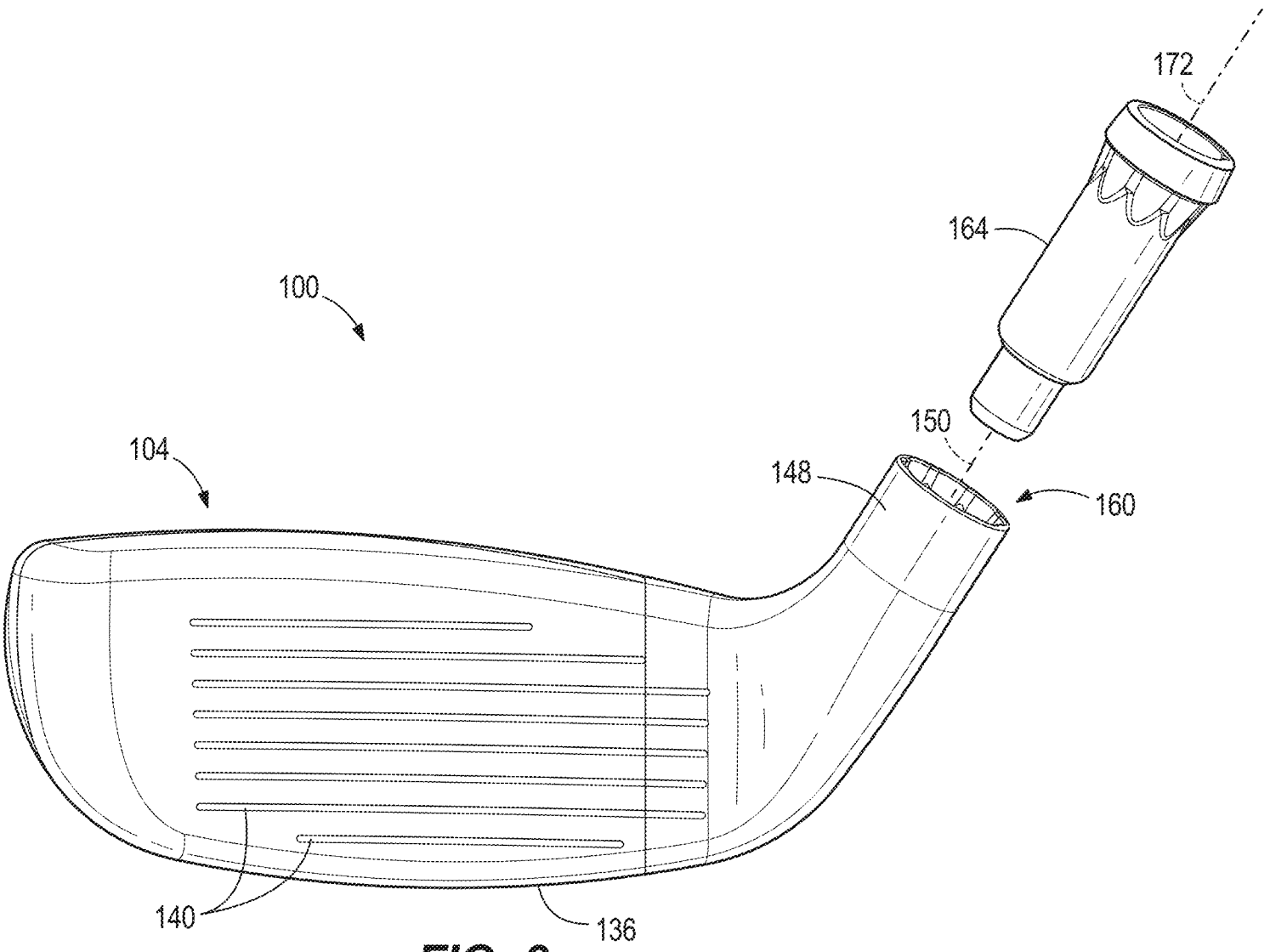
FIG. 8 is a partially exploded view of the golf club head of FIG. 1, illustrating a hosel adapter removed from a hosel adapter attachment recess.

With reference to FIG. 8, the hosel 148 of the golf club head 100 can define a hosel adapter attachment recess 160. The hosel adapter attachment recess 160 can be configured to receive a hosel adapter 164 (or a shaft sleeve 164). The hosel adapter 164 is fastened to the golf club shaft (not shown), for example by adhesive. The hosel adapter 164 is further configured to be received by the hosel adapter attachment recess 160 and selectively fastened to the club body 104 by a fastener 168 (e.g., a threaded screw, etc.) (shown in FIG. 4).

The hosel adapter 164 defines an adapter axis 172 (or a sleeve axis 172) that extends along a centerline of the hosel adapter 164. In response to a circumferential position of the hosel adapter 164 relative to the hosel adapter attachment recess 160, the adapter axis 172 can be either aligned with the hosel axis 150 or angled relative to the hosel axis 150. Stated another way, hosel adapter 164 can disengage from the hosel adapter attachment recess 160, the hosel adapter 164 can rotate relative to the hosel adapter attachment recess 160 around the hosel axis 150, and then the hosel adapter 164 can reengage with the hosel adapter attachment recess 160, fastening to the club body 104 by the fastener 168. In response to the rotational position of the hosel adapter 164 relative to the hosel adapter attachment recess 160, the hosel adapter 164 and associated golf club shaft can be angled between 0.4 degrees to 2.5 degrees relative to the hosel axis 150. In some embodiments, the adapter axis 172 can be angled between 0.4 to 1.5 degrees or 1.5 to 2.5 degrees relative to the hosel axis 150. For example, the adapter axis 172 can be angled 0.4, 0.5, 0.6, 0.8, 0.9, 1.0, 1.1, 1.2, 1.22, 1.3, 1.4, 1.5, 1.6, 1.7, 1.8, 1.9, 2.0, 2.1, 2.2, 2.3, 2.4, or 2.5 degrees relative to hosel axis 150. This facilitates adjustability of the hosel tilt for a user. An example of an embodiment of the hosel adapter attachment recess 160 and associated hosel adapter 164 is further disclosed in U.S. Published Application No. 2020/0360771, the contents of which is hereby incorporated by reference in its entirety.

With reference to FIG. 9, which is a view of the sole 120 of the golf club head 100, the sole 120 can include the weight assembly 174. The weight assembly 174 can include a removable weight 176 (or a removable sole weight 176) that is configured to be received by the weight recess 178 (or a weight port 178) (also shown in FIG. 5). The weight recess 178 is positioned in the sole 120. The weight assembly 174 can be positioned at the back end 132 of the club body 104 of the golf club head 100. By positioning the weight assembly 174 at a maximum rearward position of the sole 120 (and/or the golf club head 100), the center of gravity 154 can be moved lower (towards the sole 120 along the y-axis 156) and rearward (towards the back end 132 along the z-axis 157) (see FIG. 7) than without the weight assembly 174. This can increase a moment of inertia (or MOI) of the golf club head 100.

In the illustrated embodiment, the golf club head 100 can have a moment of inertia Ixx about the x-axis 155 (also referred to as a crown-to-sole moment of inertia), and a moment of inertia Iyy about the y-axis 156 (also referred to as a heel-to-toe moment of inertia). In some examples of embodiments, the crown-to-sole moment of inertia Ixx and the heel-to-toe moment of inertia Iyy are increased or maximized based on the amount of discretionary mass available to the club head designer. The golf club head 100 can have a crown-to-sole moment of inertia Ixx of approximately 675 $g \cdot in^2$ to approximately 700 $g \cdot in^2$, and more specifically approximately 677 $g \cdot in^2$ to approximately 697 $g \cdot in^2$. The golf club head 100 can have a heel-to-toe moment of inertia Iyy of approximately 2150 $g \cdot in^2$ approximately 2225 $g \cdot in^2$, and more specifically approximately 2174 $g \cdot in^2$ to approximately 2200 $g \cdot in^2$.

Figure 5:
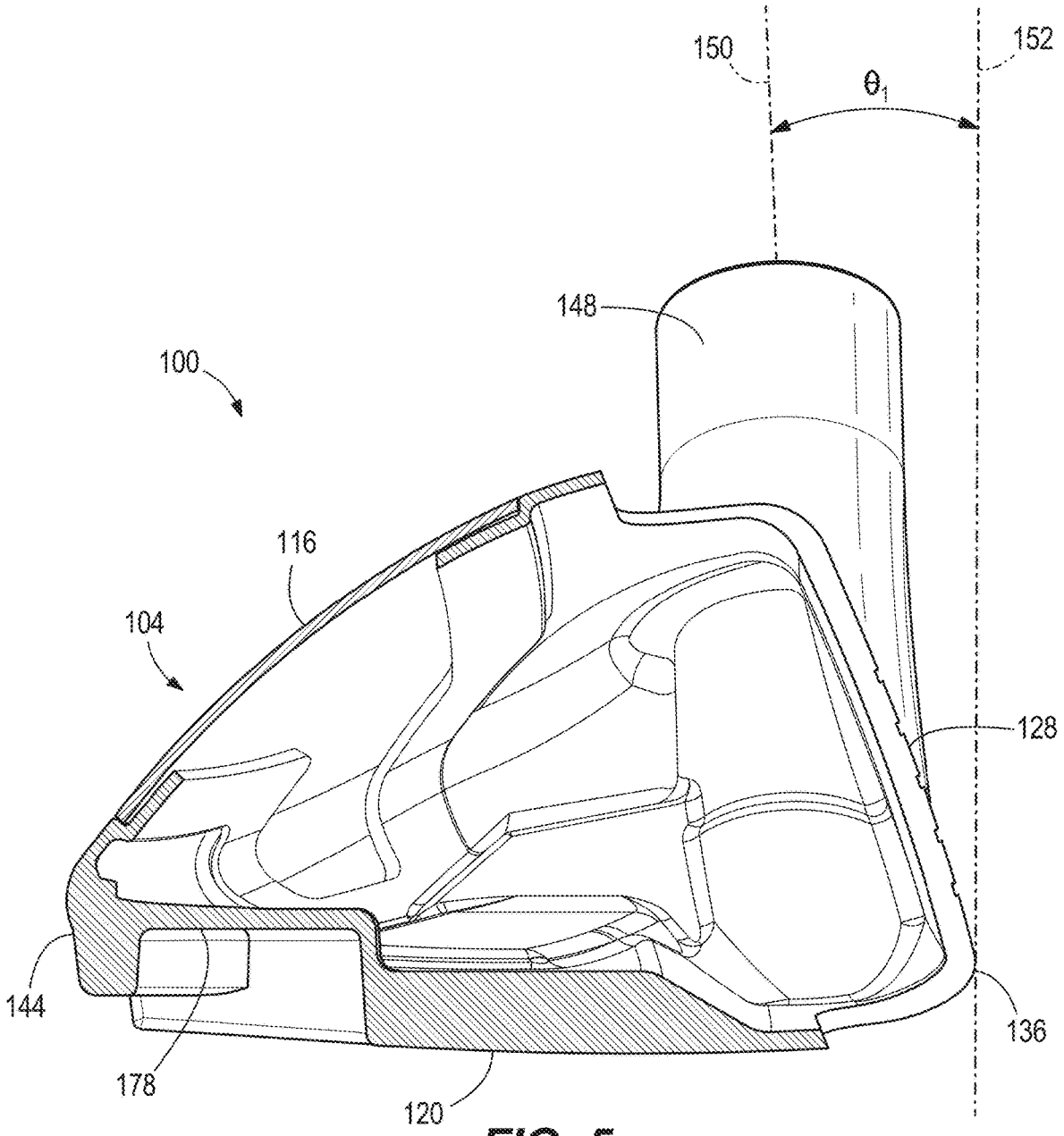
FIG. 5 is a cross-sectional view of the golf club head of FIG. 1, taken along line 5-5 of FIG. 4 as viewed from a toe towards a heel.
Figure 6:
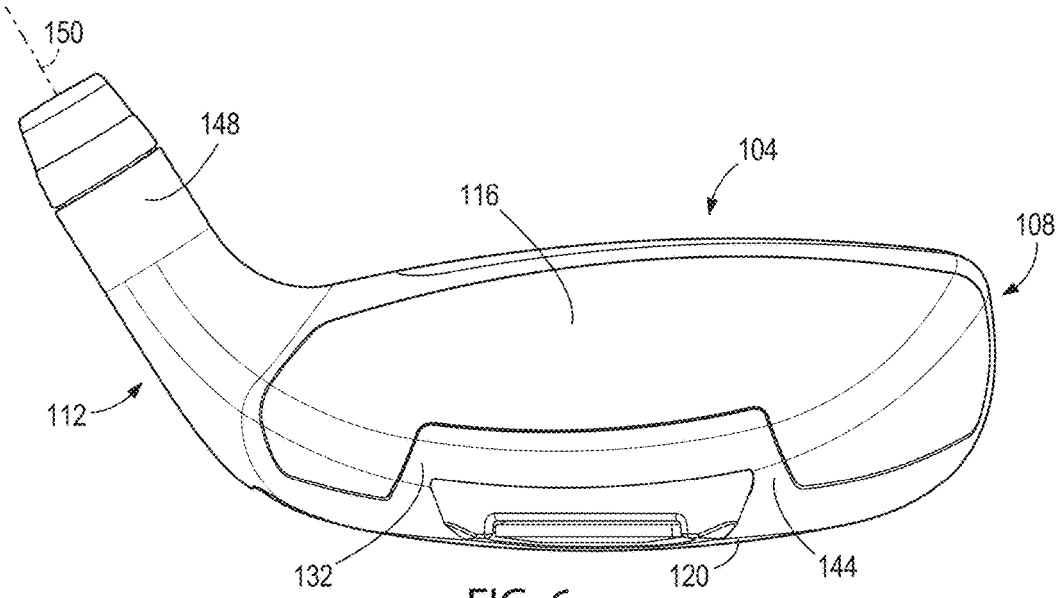
FIG. 6 is a second side view of the golf club head of FIG. 1, illustrating a rear side.

The removable weight 176 can define a through hole that is configured to receive a threaded fastener 181. The weight recess 178 can define a corresponding threaded bore (not shown) configured to receive the threaded fastener 181 to removably fasten the removable weight 176 to the weight recess 178, and in turn to the golf club head 100. The weight recess 178 can be recessed from an outer surface of the sole 120 (as shown in FIG. 5). This is to allow the removable weight 176 to be flush with the outer surface of the sole 120 when the removable weight 176 is secured within the weight recess 178.

The removable weight 176 can be formed of a material such as steel, tungsten, aluminum, titanium, vanadium, chromium, cobalt, nickel, other metals, metal alloys, composite polymer materials or any combination thereof. In many embodiments, the removable weight 176 can be tungsten.

The removable weight 176 can define a mass. The mass of the removable weight 176 can range from approximately 1.0 gram to approximately 35 grams. In some examples of embodiments, the mass of the removable weight 176 can range from 1.0 gram to 20 grams, or from 20 grams to 35 grams. In some examples of embodiments, the mass of the removable weight 176 can range from 1.0 gram to 15 grams, from 5 grams to 20 grams, from 10 grams to 25 grams, from 15 grams to 30 grams, or from 20 grams to 35 grams. For example, the mass of the removable weight 176 can be 1.0 gram, 1.5 grams, 2.0 grams, 3.0 grams, 4.0 grams, 5.0 grams, 6.0 grams, 7.0 grams, 8.0 grams, 9.0 grams, 10 grams, 11 grams, 12 grams, 13 grams, 14 grams, 15 grams, 16 grams, 17 grams, 18 grams, 19 grams, 20 grams, 21 grams, 22 grams, 23, grams, 24, grams, 25 grams, 26 grams, 27 grams, 28 grams, 29, grams, 30 grams, 31 grams, 32 grams, 33 grams, 34 grams, or 35 grams. In one example, the mass of the removable weight 176 can be 10 grams. In another example, the mass of the removable weight 176 can be 13 grams. In other examples of embodiments, the mass of the removable weight 176 can be any suitable or desired number of grams.

Figure 11:
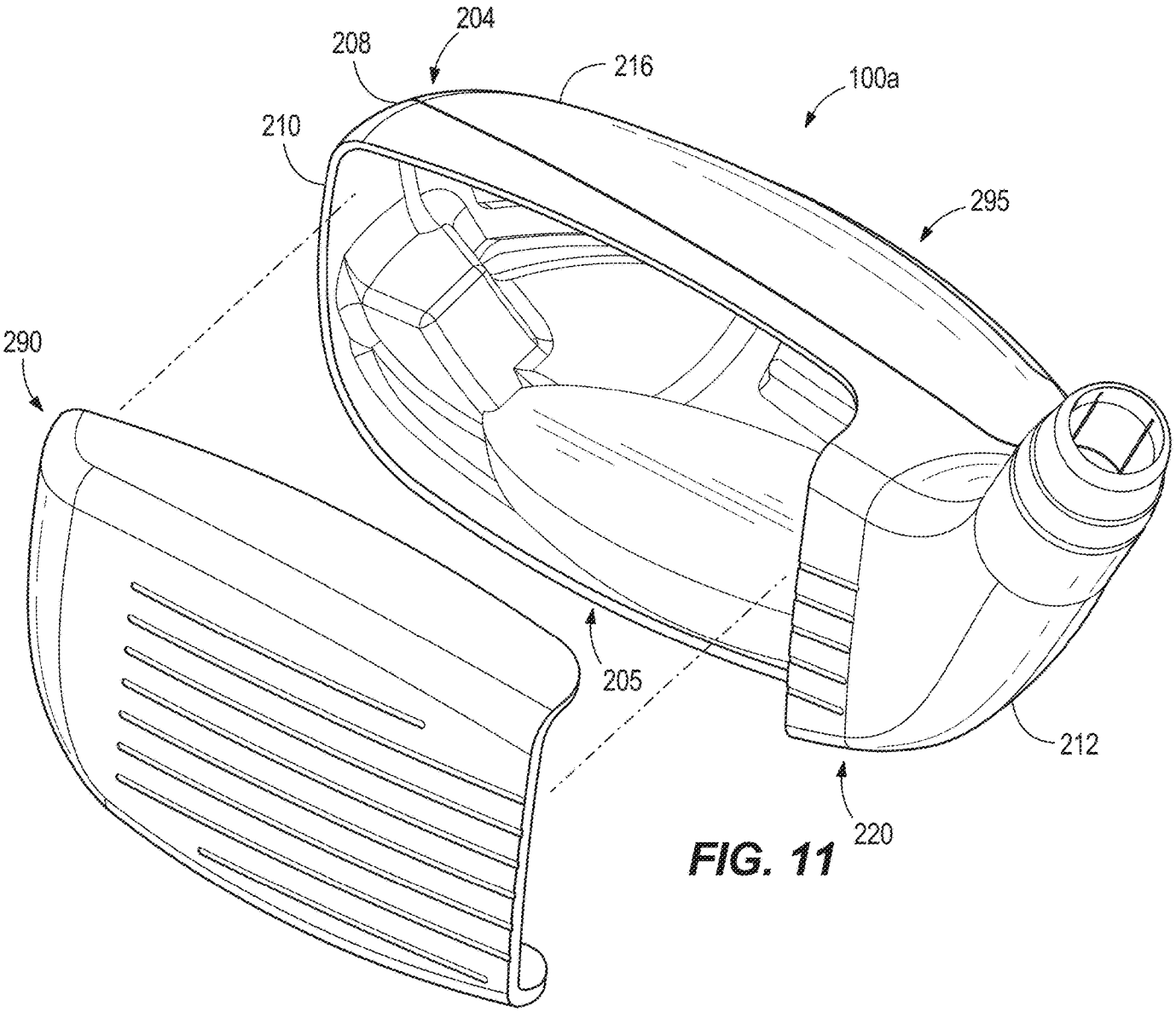
FIG. 11 is a partially exploded view of an embodiment of a golf club head illustrating a face cup detached from a club body.

With reference now to FIG. 11, another example of an embodiment of a golf club head 200 is illustrated. Golf club head 200 is substantially the same as golf club head 100, except that golf club head 200 incorporates a face cup 290. For ease of reference, like numbers will be used to identify like components. It should be appreciated that the face cup 290 has similarities to the face plate 124 of the golf club head 100, described above. The term "face cup" as described herein, is defined as a component configured to be permanently affixed to an aperture positioned in a front portion a golf club head body 204.

As illustrated in FIG. 11, the golf club head body 204 of the golf club head 200 defines an opening 205 (or a recess 205). The opening 205 is configured to receive the face cup 290. The opening 205 includes a lip 210 that extends around a perimeter of the opening 205. The face cup 290 is configured to be aligned with the opening 205 and abut the lip 210. The face cup 290 is configured to be secured, or otherwise fastened, to the club body 104 by welding, forming a golf club head assembly 200. In one example, the welding is a pulse plasma welding process. In other examples, the face cup 290 can be fastened to the club body 104 at the opening 205 by any suitable welding, connection, or attachment process. The face cup 290 and the club body 104 together define a substantially hollow, closed interior volume.

Figure 12:
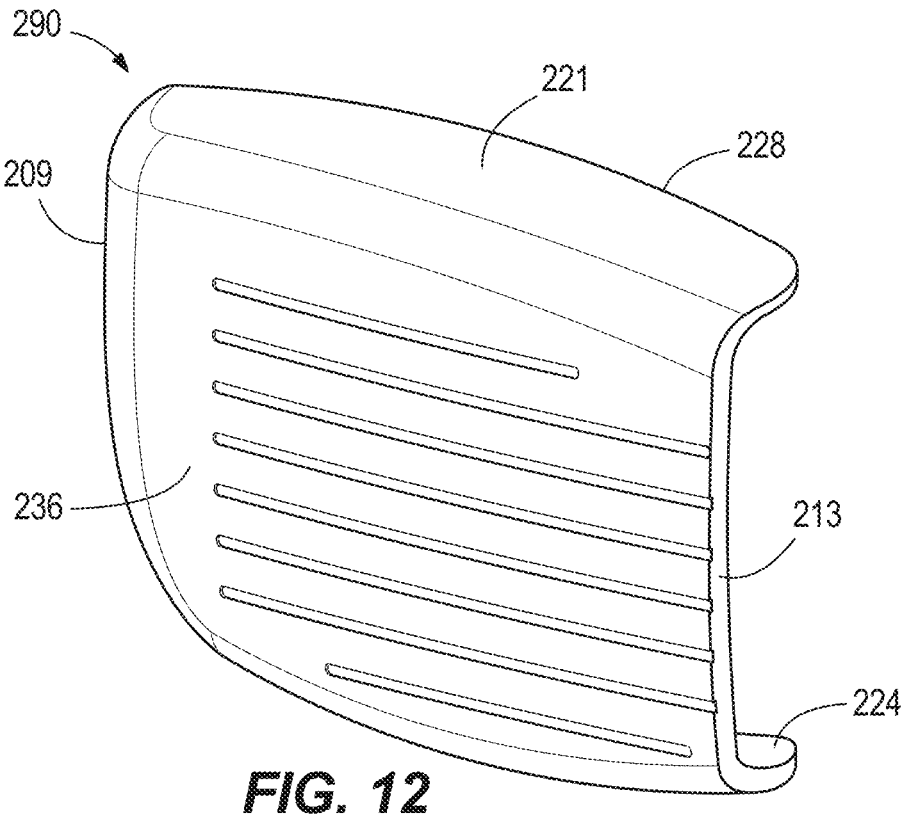
FIG. 12 is a perspective view of a first side (or strike face side) of the face cup of FIG. 11.
Figure 13:
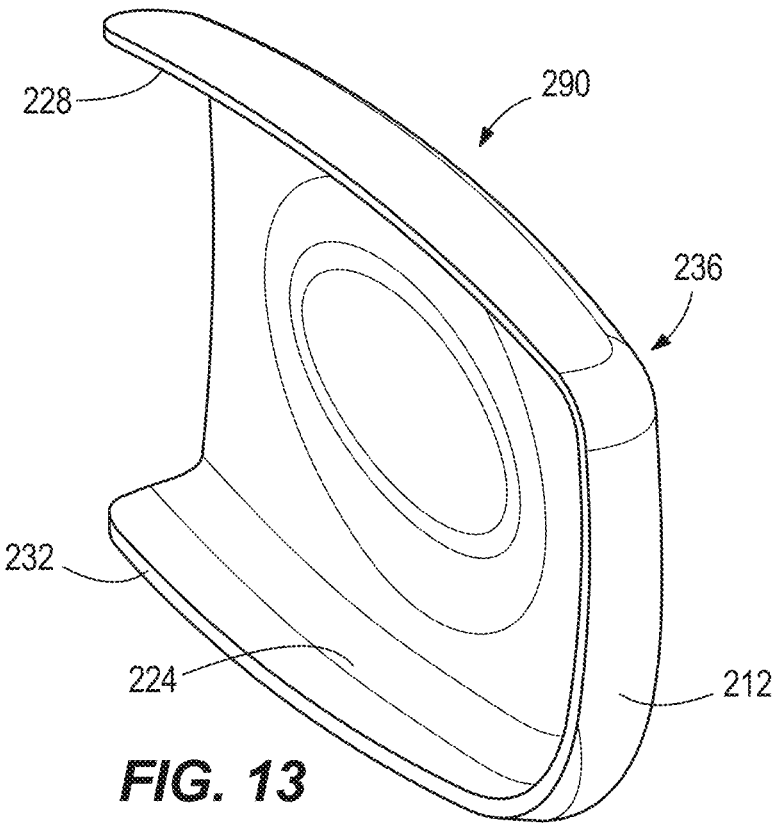
FIG. 13 is a perspective view of a second side (or rear side) opposite the first side of the face cup of FIG. 12.

With reference to FIGS. 12 and 13, the face cup 290 includes a face cup toe portion 209, a face cup heel portion 213, a face cup crown return 221, and a face cup sole return 224. The face cup toe portion 209 is opposite the face cup heel portion 213. Similarly, the face cup crown return 221 is opposite the face cup sole return 224. The face cup crown return 221 defines a crown edge 228, while the face cup sole return 224 defines a sole edge 232. The face cup 290 is configured to be received within and permanently affixed to the opening 205 (or aperture 205) defined by the club body 104 to form a front portion of the golf cub head 200. The face cup crown return 221, the face cup sole return 224, and the face cup toe portion 209 surround a face cup strike face portion 236.

The face cup crown edge 228 defines a peripheral edge of the face cup crown return 221. The face cup sole edge 232 defines a peripheral edge of the face cup sole return 224. The face cup crown edge 228 is configured to be positioned adjacent an upper edge of the lip 210 of the club head body 104 (shown in FIG. 11), while the face cup sole edge 232 is configured to be positioned adjacent a lower edge of the lip 210 of the club head body 104 (shown in FIG. 11). Stated another way, the face cup crown edge 228 and the face cup sole edge 232 are configured to abut the lip 210 of the aperture 205. In alternative examples of embodiments of the face cup 290, one of the crown return 221 or the sole return 224 can be optional. For example, in one embodiment, the face cup 290 can include the sole return 224 while lacking the crown return 221. In another embodiment, the face cup 290 can include the crown return 221 while lacking the sole return 224. Other examples of embodiments can include the face cup 290 having a portion of the crown return 221 (not extending along the entire width of the crown in a heel to toe direction) and/or having a portion of the sole return 224 (not extending along the entire width of the sole in a heel to toe direction).

With reference back to FIG. 11, in one or more examples of embodiments, the golf club head 200 can define a first component 295 and a second component 204. In some embodiments the second component is similar to club body 104 described above. In one embodiment, the first component 295 and the second component 204 can be formed of a similar material (e.g., metallic material, etc.). In another example of embodiment, the golf club head 200 can comprise composite portions. The first component 295 can be defined by a lightweight non-metallic structure that wraps around a portion of the second component 204, which is defined by a metallic structure. The first component 295 can form portions of the toe end 208, the heel end 212, the crown 216, the sole 220, and the skirt (not shown but similar to the skirt 144). The first component 295 can reduce the mass within the crown 216. This allows for additional discretionary mass to be distributed to the second component 204 or the removable weight (not shown but similar to removable weight 176). Further, the first component 295 can reduce the mass within the toe end 208, the heel end 212, or the sole 220. By using a non-metallic first component 295 and taking the mass savings from the toe end 208, the heel end 212, the crown 216, the sole 220, and the skirt (not shown), the mass can be positioned into the removable weight (not shown) and/or the second component 204 to lower a center of gravity, increase a moment of inertia, decrease a golf ball spin, and/or increase a loft/launch angle. The combination of a wrap-around composite design and/or removable weights can provide a hybrid with a lower center of gravity that improves forgiveness and reduces golf ball spin relative to a golf club head that does not include the non-metallic first component 295 and the metallic second component 204.

The golf club heads 100, 200, and golf club head body 304 disclosed herein provide certain advantages. For example, the hybrid golf club heads 100, 200, and golf club head body 304 have a slightly open resting face angle to provide a visual aesthetic at setup that is preferred by a lower handicap golfer. The hybrid golf club heads 100, 200, and golf club head body 304 also incorporate a smaller volume of approximately 90 cc to approximately 130 cc, and more specifically approximately 108 cc to approximately 110 cc. The smaller size provides a more compact club shape that is preferred by a lower handicap golfer. In addition, the hosel 148 incorporates a negative hosel tilt, which is preferred by lower handicap players, as it allows the player to position their hands behind the ball (or towards a trail or rear foot of the player) at the address position. These and other advantages are realized by the disclosure herein.

EXAMPLE 1 (HYBRID RFA)

In a performance test, a first exemplary golf club head was compared to a first control golf club head, and a second control golf club head. The first exemplary golf club comprised a hybrid type golf club which further comprised an open RFA of 1.5 degree (i.e., pointing right of the intended target line for a right-handed player and left of the intended target line for a left-handed player). The first control golf club head comprised a hybrid type golf club which further comprised a square RFA of 0 degrees (i.e., the golf club face did not create an angle between the intended target line). The second control golf club head comprised a hybrid type golf club which further comprised a closed RFA of 1.5 degree (i.e., pointing left of the intended target line for a right-handed player and right of the intended target line for a left-handed player.

Twenty-three players were asked to hit 10 shots with each club. Once the players had completed the shots, they were asked to rate each club, the first exemplary golf club head, the first control golf club head, and the second control golf club head, on a scale of 1-5 based on how satisfied they were with the hybrid looking square at address. In other words, how satisfied they were with the golf club comprising an RFA that does not create an angle with the intended target line.

The first exemplary golf club head received an average score of 4.29 out of 5 across the twenty-three players. The first control golf club head received an average score of 3.96 out of 5 across the twenty-three players. The second control golf club head received an average score of 2.88 out of 5 across the twenty-three players. Therefore, a closed RFA, as was presented in the second control golf club head, is extremely dissatisfying to players. The square RFA, as presented in the first control golf club head, is satisfactory to players, however, it is not the preferred RFA. The open RFA, as presented in the first exemplary golf club head, was perceived as the club head that set up the squarest RFA at address and therefore is the preferred RFA for a hybrid type golf club.

EXAMPLE 2 (HYBRID VS. CROSSOVER)

In a second performance test, a second exemplary golf club was compared to a third control golf club head. The performance test measured the ball speeds, launch angles, spin rates, and carry distance of the second exemplary golf club head and the third control golf club head over 17 different players. Each of the 17 players hit 10 shots with each of the second exemplary golf club and the third control golf club head. Performance characteristics values were averaged using data collected.

The second exemplary golf club head was similar in many ways to golf club head 100 described above and comprised a driving-iron-type construction. The second exemplary golf club head comprised a 1.5-degree open RFA and a 1.5-degree hosel tilt. The second exemplary golf club head comprised a 108 cc volume and a loft angle of 19.5 degrees. The third control club head comprised a hollow body iron construction. The third control club head comprised a 0-degree RFA and 0-degree hosel tilt. The third control club head comprised a 51 cc volume and a loft angle of 19.5 degrees.

TABLE 1

| | Avg. Ball Speed (mph) | Avg. Launch Angle (deg) | Avg. Spin Rate (RPM) | Avg. Carry Distance (yds) |
|---|---|---|---|---|
| Second Exemplary Club Head | 145.9 | 11.6 | 4182.7 | 231.3 |
| Third Control Club Head | 142.8 | 11.6 | 4010.5 | 225.8 |

Average data values resulting from the performance test are summarized in Table 1. The performance test showed the second exemplary golf club head having a ball speed of 145.9 mph, a launch angle of 11.6 degrees, a spin rate of 4182.7 RPM, and 231.3 yards of carry. The performance test showed the third control club head having a ball speed of 142.8 mph, a launch angle of 11.6 degrees, a spin rate of 4010.5 RPM, and 225.8 yards of carry. The second exemplary golf club head outperformed the third control club head for ball speed, providing 3.1 mph more ball speed and for carry distance, providing 5.5 yards more carry distance. The second exemplary golf club head provided the same launch angle of 11.6 degrees. In conclusion, the second exemplary club head provides a player with similar performance characteristics and improved performance characteristics when compared with the third control club head. Further, the second exemplary club head provided a preferred address aesthetic as noted in Example 1 above.

EXAMPLE 3 (HYBRID VS. HYBRID)

In a third performance test, a third exemplary golf club was compared to a fourth control golf club head. The performance test measured the ball speeds, launch angles, spin rates, and carry distance of the third exemplary golf club head and the control golf club head over 20 different players. Each of the 20 players hit 10 shots with the third exemplary golf club and the fourth control golf club head. Once all shot data was collected all performance characteristics were averaged.

The third exemplary golf club head was similar in many ways to golf club head 100 described above. The third exemplary golf club head comprised a 1.5-degree open RFA and a 1.5-degree hosel tilt. The third exemplary golf club head comprised a 108 cc volume and a loft angle of 17.5 degrees. The fourth control club head comprised a 1.5-degree closed RFA and a 0-degree hosel tilt. The fourth control club head comprised a 128 cc volume and a 17.5 degree loft angle.

The third exemplary golf club head comprised a 1.5-degree open RFA and a 1.5-degree hosel tilt. The third exemplary golf club head comprised a 108 cc volume. The third exemplary golf club head comprised a 17.5 degrees loft. The third exemplary golf club head was substantially similar to golf club head 100 described above.

TABLE 2

| | Avg. Ball Speed (mph) | Avg. Launch Angle (deg) | Avg. Spin Rate (RPM) | Avg. Carry Distance (yds) |
|---|---|---|---|---|
| Third Exemplary Club Head | 142.9 | 9.1 | 3774.6 | 216.9 |
| Fourth Control Club Head | 142.7 | 9.4 | 3851.5 | 217.6 |

Average data values resulting from the performance test are summarized in Table 2. The performance test showed the third exemplary golf club head having a ball speed of 142.9 mph, a launch angle of 9.1 degrees, a spin rate of 3774.6 RPM, and 216.9 yards of carry. The performance test showed the fourth control club having a ball speed of 142.7 mph, a launch angle of 9.4 degrees, a spin rate of 3851.5 RPM, and 217.6 yards of carry. The third exemplary golf club head outperformed the control club head for ball speed, providing 3.1 mph more ball speed, and for carry distance, providing 5.5 yards more carry distance. The third exemplary golf club head provided the same launch angle 11.6 degrees. The third exemplary club head provides a player with improved performance characteristics when compared with the fourth control club head. Further, the third exemplary club head provided a preferred address aesthetic as noted in Example 1 above.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a hybrid-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following clauses and claims.

Clause 1: A golf club head comprising: a club body having a crown opposite a sole, a toe end opposite a heel end, a club face opposite a back end, and a hosel; and a hosel axis defined by the hosel, the hosel axis is oriented relative to a plane perpendicular to a surface upon which the sole rests at address to define a hosel tilt, the hosel tilt being greater than zero degrees, wherein the club body defines a resting face angle that is open relative to an intended target line.

Clause 2: The golf club head of clause 1, wherein the club body has a volume of 90 cubic centimeters to 130 cubic centimeters.

Clause 3: The golf club head of clause 1, wherein the club body has a volume of 108 cubic centimeters to 110 cubic centimeters.

Clause 4: The golf club head of clause 1, wherein the hosel tilt is 0.5 degrees to 2.0 degrees.

Clause 5: The golf club head of clause 1, wherein the hosel tilt is at least 1.5 degrees.

Clause 6: The golf club head of clause 1, wherein the resting face angle is at least 0.5 degrees open.

Clause 7: The golf club head of clause 1, wherein the resting face angle is 0.5 degrees to 1.0 degrees open.

Clause 8: The golf club head of clause 1, further comprising a center of gravity, the center of gravity is positioned between the toe end and a geometric center of the club face.

Clause 9: The golf club head of clause 8, wherein the center of gravity is positioned at least 0.001 inches towards the toe end from the geometric center of the club face.

Clause 10: The golf club head of clause 8, wherein the center of gravity is positioned between 0.001 inches and 0.25 towards the toe end from the geometric center of the club face.

Clause 11: The golf club head of clause 1, further comprising a first keel point defined by a first portion of the sole; a second keel point defined by a second portion of the sole; and a center of gravity, the center of gravity is positioned between the first keel point and the second keel point.

Clause 12: The golf club head of clause 11, wherein the first keel point is positioned between the center of gravity and the club face.

Clause 12: The golf club head of clause 11, wherein the first keel point is positioned between the center of gravity and the club face.

Clause 13: The golf club head of clause 11, wherein the second keel point is positioned between the center of gravity and the back end.

Clause 14: The golf club head of clause 13, wherein the first keel point comprises a first keel point height between 0.455 inches to 0.465 inches; and the second keel point comprises a second keel point height between 0.445 inches to 0.455 inches.

Clause 15: The golf club head of clause 13, wherein the first keel point comprises a first keel point height between 0.455 inches to 0.465 inches; and the second keel point comprises a second keel point height between 0.325 inches to 0.400 inches.

Clause 16: The golf club head of clause 13, wherein the first keel point comprises a first keel point height; the second keel point comprises a second keel point height; and the difference between the first keel point height and the second keel point height is between 0.001 inches to 0.01 inches.

Clause 17: The golf club head of clause 13, wherein the first keel point comprises a first keel point height; the second keel point comprises a second keel point height; and the difference between the first keel point height and the second keel point height is between 0.005 inches to 0.140 inches.

Clause 18: The golf club head of clause 11, further comprising a weight port defined by a portion of the sole and configured to removably receive a weight, a portion of the weight port defines the second keel point.

Clause 19: The golf club head of clause 1, further comprising a weight assembly, the weight assembly including a weight port defined by a portion of the sole and a weight removably received by the weight port.

Clause 20: The golf club head of clause 19, wherein the first keel point comprises a first keel point height; the second keel point comprises a second keel point height; and the difference between the first keel point height and the second keel point height is between 0.005 inches to 0.140 inches.

The invention claimed is:

1. A golf club head comprising:

a club body, the club body having a crown opposite a sole, a toe end opposite a heel end, a club face opposite a back end, and a hosel;

a hosel axis defined by the hosel; wherein the hosel axis is oriented relative to a plane perpendicular to a surface upon which the sole rests at address to define a hosel tilt, the hosel tilt being greater than zero degrees;

wherein the club body defines a resting face angle that is open relative to an intended target line;

a first keel point defined by a first portion of the sole;

a second keel point defined by a second portion of the sole;

a center of gravity, the center of gravity is positioned between the first keel point and the second keel point;

the second keel point is positioned between the center of gravity and the back end; and the first keel point comprises a first keel point height between 0.455 inches to 0.465 inches; and the second keel point comprises a second keel point height between 0.445 inches to 0.455 inches, wherein the first keel point height is greater than the second keel point height.

2. The golf club head of claim 1, wherein the club body has a volume of 90 cubic centimeters to 130 cubic centimeters.

3. The golf club head of claim 1, wherein the club body has a volume of 108 cubic centimeters to 110 cubic centimeters.

4. The golf club head of claim 1, wherein the hosel tilt is 0.5 degrees to 2.0 degrees.

5. The golf club head of claim 1, wherein the hosel tilt is at least 1.5 degrees.

6. The golf club head of claim 1, wherein the resting face angle is at least 0.5 degrees open.

7. The golf club head of claim 1, wherein the resting face angle is 0.5 degrees to 1.0 degrees open.

8. The golf club head of claim 1, further comprising a center of gravity, the center of gravity is positioned between the toe end and a geometric center of the club face.

9. The golf club head of claim 8, wherein the center of gravity is positioned at least 0.001 inches towards the toe end from the geometric center of the club face.

10. The golf club head of claim 8, wherein the center of gravity is positioned between 0.001 inches and 0.25 towards the toe end from the geometric center of the club face.

11. The golf club head of claim 1, wherein the first keel point is positioned between the center of gravity and the club face.

12. The golf club head of claim 1, and a difference between the first keel point height and the second keel point height is between 0.001 inches to 0.01 inches.

13. The golf club head of claim 1, and a difference between the first keel point height and the second keel point height is between 0.005 inches to 0.140 inches.

14. The golf club head of claim 1, further comprising a weight port defined by a portion of the sole and configured to removably receive a weight, wherein a portion of the weight port defines the second keel point.

15. The golf club head of claim 1, further comprising a weight assembly, the weight assembly including a weight port defined by a portion of the sole and a weight removably received by the weight port.

16. The golf club head of claim 15, and a difference between the first keel point height and the second keel point height is between 0.005 inches to 0.140 inches.

* * * * *